United States Patent [19]

Bergström et al.

[11] Patent Number: 4,811,855

[45] Date of Patent: Mar. 14, 1989

[54] CONTAINER CLOSURE

[75] Inventors: Magnus Bergström, Bhärred; Stefan Gersbro; Jan-Olof Fransson, both of Lund, Sweden

[73] Assignee: AB Akerlund & Rausing, Sweden

[21] Appl. No.: 200,651

[22] Filed: May 31, 1988

[30] Foreign Application Priority Data

Jun. 9, 1987 [SE] Sweden ..... 8702379
Jun. 9, 1987 [SE] Sweden ..... 8702378

[51] Int. Cl.[4] ..... B65D 41/34
[52] U.S. Cl. ..... 215/243
[58] Field of Search ..... 215/243, 252, 253

[56] References Cited

U.S. PATENT DOCUMENTS 3,110,410 11/1963 Pehr ..... 215/243
4,394,918 7/1983 Grussen ..... 215/243

*Primary Examiner*—George T. Hall
*Attorney, Agent, or Firm*—Lerner, David, Littenberg, Krumholz & Mentlik

[57] ABSTRACT

A container closure of the so-called spout type comprises a female element and a male element. The female element is attachable to a flexible container wall section, and the male element is attachable to an opposite wall portion, such that a container, for instance a four sided edge sealed pouch of the giant size type, is closable by arranging the female element and the male element in a sealing engagement for forming a closure. An axially operating arrangement for providing relative axial movement between the male and female elements, for instance of the bayonet type is arranged for providing an axial or relative movement of the female and male elements, such that an axial sealing ring will be compressed. The sealing of such ring may be supplemented by the sealing effect obtained by means of the ribs and grooves of the device. As a further specific feature the seal may include bacteria killing material, for instance of the ZEOLIT-type. According to a further aspect of this invention a device is sealed gas and vapour tight, against the female element and forms a barrier layer, such that a buffert space is formed between the barrier layer and the male element, said buffert space being highly sterilizable, for instance by gamma radiation, together with the rest of the container.

11 Claims, 2 Drawing Sheets

CONTAINER CLOSURE

FIELD OF THE INVENTION

The present invention relates to a container closure of the type comprising a female element attachable to a container wall portion, preferably a flexible wall, and a male element attachable to on opposite wall, preferably also a flexible one, where said elements are movable to and from each other and the male element is insertable in the female element from the inside of the container for forming a closure together with the female element for a container comprising said wall portions.

BACKGROUND OF THE INVENTION

The seal obtainable by a closure of the said type is good and basically obtained by radially acting seal rings, possibly in combination with a sealing membrane sealing the male element and the female element against the environment.

The movement pattern for the prior art sealing device or the so-called spout is extremely simple; the elements are separated and assembled simply by axial relative movement.

The prior art closures do also have the advantage that the elements forming a part of the container closure are easily maneuverable and, in a sealed condition do maintain the sterility of a sterilizable packaging container basically up to the moment when the container is opened by separating the male and female elements.

Generally, such a separation takes place under sterile conditions, for instance by placing a filler orifice into abutment against the female element where the orifice has an arrangement for sterilizing, for instance steam sterilizing, and accomplishes sterilization of the external side of the combined arrangement of the female element and the male element before such elements are separated.

A packaging container without food contents, generally may be sterilized without breaking any regulations by using an energy rich radiation, for instance, gamma radiation. Such a sterilizing procedure gives a high quality sterile environment for the further handling of the container.

However, the regulations are such that, in general, sterilization of food products by high energy radiation is not allowed. This means that in practice it is necessary to find a partition wall or border line between a space in which radiation sterilization is acceptable and another space where such sterilization is not acceptable. In the known container structure comprising a male and a female element or a so-called spout, such partition is defined by the external side of the male element, the free circumferential edge of the female element and a seal, an O-ring, arranged between the said portions.

Such a partition forms a discontinuous surface having pronounced microorganism pockets which are not very simple to sterilize by using water vapour.

SUMMARY OF THE INVENTION

According to a first aspect of the present invention, in order to improve the sealing characteristics of a spout, it is now suggested a positively activatable axial sealing device obtained by locking engagement between the male element and the female element.

The invention provides a container closure comprising a female element attachable to a container wall, preferably a flexible wall, and a male element attachable to an opposite wall portion, preferably also of flexible material, where said elements are arranged for being brought into sealing engagement and the male element is arranged for being inserted into the female element from the inside of the container for closing a container where said wall portions form a part of the container.

An axially operating sealing device is arranged between the male element and the female element, and an axial locking device between said elements compresses the female and the male elements axially and thereby also a sealing device between said elements. For instance, the locking device provides an axial relative displacement of the male element and the female element, for instance of the type observed in bayonet couplings.

In one embodiment the sealing device comprises a sealing ring arranged between a circumferential edge region and the outside end surface of the male element and the inside of an edge region extending all around the bottom of the female element.

In a further preferred embodiment a sealing membrane is sealed, gas and vapour tight, against the outside of the circumferential edge region of the female element.

In a specific embodiment of the present invention the sealing device and/or the material of the male and female elements is a bacteria killing material, for instance "ZEOLIT".

According to a second aspect, the object of the present invention is to offer an arrangement which does not negatively influence the theoretically possible sterilization conditions of the combined effect of radiation sterilization and steam sterilization.

The present invention provides a container closure comprising a female element attachable to a container wall, preferably flexible wall, and a male element attachable to an opposite container wall, preferably also flexible, where said elements are arranged for being sealingly mountable and demountable and the male element is arranged for being inserted into the female element from the inside of the container for sealing and forming a closure of a container, of which said container walls form part.

In order to broaden the concept of radiation sterilization, there is arranged a device which is gas and vapour tight sealed against the female element for forming a barrier layer, and between said barrier layer and the male element there is formed a buffert space, which is highly sterilizable, for instance, by gamma radiation, together with the rest of the container.

In one embodiment the female element has means for connecting the side of the barrier layer facing way from the buffert space to a filler orifice which is sterilizable by water vapour or other suitable means.

In a preferred embodiment there is arranged a barrier layer comprising a heat shrinkable plastics material or a plastics laminate, possibly in combination with a metal foil, which ruptures and exposes the buffert space after a steam sterilization.

In another preferred embodiment the barrier layer comprises a sealing foil attachable to the outside of the male element, for instance a foil of plastics or plastics laminate, possibly having metal contents, said foil or membrane being attached to the male element such that it ruptures substantially along a line defining the opening of the female element when the male element is separated from the female element.

Preferably, the barrier layer has a weakening or a tearing denotation for obtaining said tearing-through line.

DESCRIPTION OF PREFERRED EMBODIMENTS

Figure 1:
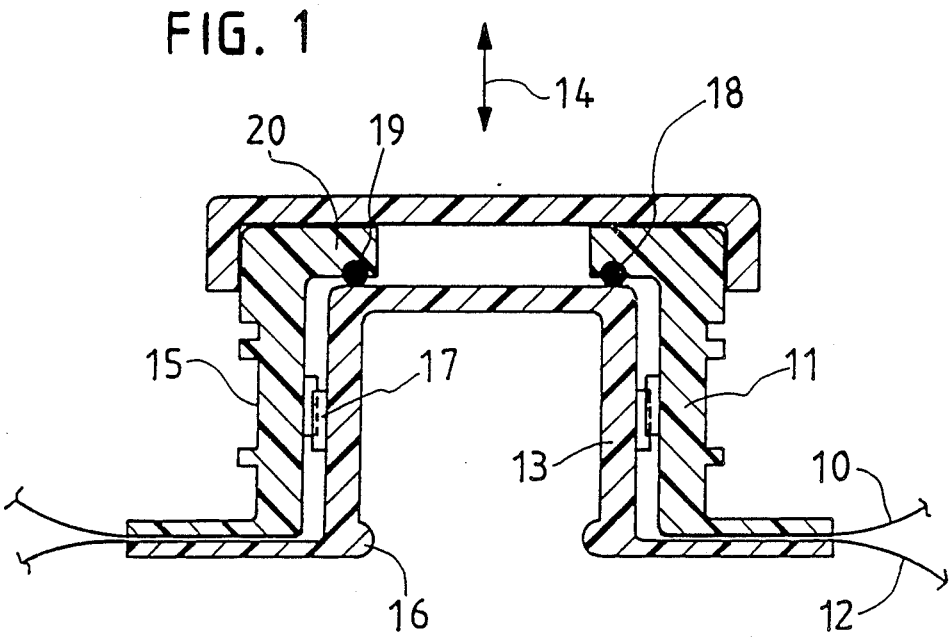
FIG. 1 shows a spout comprising a male element and a female element and provided with a locking and sealing arrangement according to the present invention.

A female element 11 of generally cylindric shape is attached, gas and vapour tight, on to a flexible container wall section 10. A male element 13 is attached in a corresponding manner onto said wall section at an opposite flexible container wall portion 12. The wall portion sections 10, 12 form part of a so-called giant size pouch, for instance of a volume of 100 liters or more, basically consisting of a pouch sealed along four edge regions and manufactured from for instance metallized polyester or similar material.

The basic design of the elements 11, 13 forming the so-called spout allows a simple pattern of movement when filling and emptying, respectively, the container. Basically, there is needed just a relative axial movement in the direction of the double arrow 14.

In practice it is preferred to arrange the female element 11 stationary by letting a support grip into a circumferential groove 15 at the outside of the female element. The male element 13 is operated by inserting an expandable rod into the internal part of the male element and arranging the expandable rod for gripping behind a circumferential bead 16 in the cavity formed by the interior portion of the male element 13.

Figure 2:
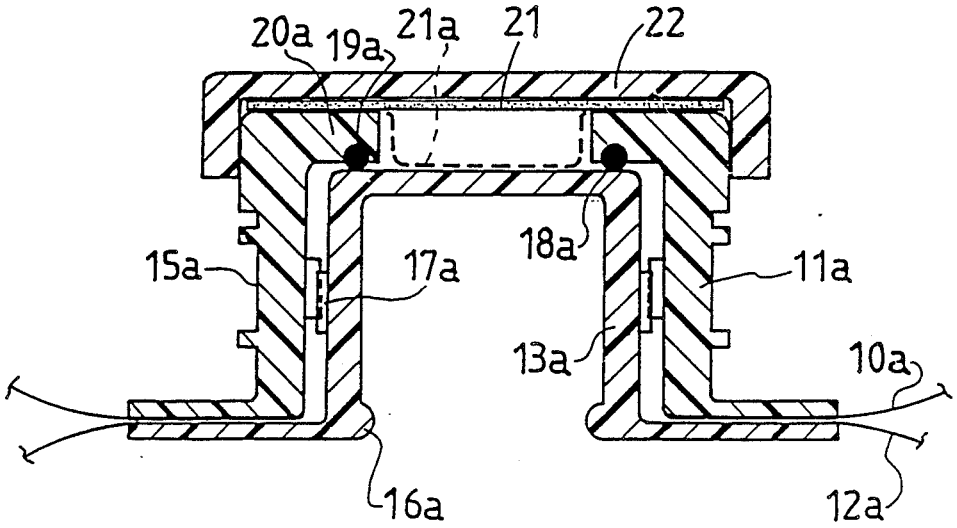
FIG. 2 shows a spout in FIG. 1 but provided with a sealing membrane.

In order to obtain a positive locking in the axial direction, in the embodiment according to FIGS. 1 and 2, there is an arrangement of ribs and grooves 17 forming a lock of bayonet type and an arrangement providing positive axial contraction of the female element 11 and the male element 13. Such arrangement allows the use of an axially operating sealing ring 18 which is supported in a groove 19 at the lower side of an under cut portion 20 of the female element. The sealing ring 18 may also be replaced by a sealing bead formed integrally with adjacent portions of the female element, for instance by interval injection moulding of a bead.

Because the container wall portions 10, 12 are of a flexible material or because of the attachment of the male element and the female element there is allowed a certain rotational movement around the centre axis of the spout, implying that the bayonet locking arrangement may be brought into another one of two axial extreme positions relative the positions of the elements 11, 13 in order to provide an axial compression of the sealing ring 18.

The axial seal may of course be supplemented by a radial seal, for instance a sealing ring of the conventional type.

In FIG. 2 there is shown parts corresponding to the ones in FIG. 1 and with the same reference numbers but with the addition of a. A sealing membrane **21*a* has been arranged, a membrane which is attached, gas and vapour tight, to the upper side of the under cut region of the female element and which preferably is protected by an outer simple cover 22*a* against puncture due to rough handling. The idea is that the membrane 21*a* should eliminate the vapour traps which otherwise are formed, for instance in the area of the sealing ring 18*a***, at the vapour sterilization step that normally precedes the separation of the female and male elements and the filling operation following thereafter. Present regulations allow sterilization of a packaging container—without food product contents, by using for instance gamma radiation.

In the arrangement of ribs and grooves **17*a* for providing the axial relative movement between the female and male elements 11*a*, 13*a*** there may be built in a certain sealing function, even a combination of radially and axially operating seals. It is for instance possible to do so by using the previously mentioned so-called interval injection moulding technique.

The phantom lines **21*a*–*i* FIG. 2 show a "self-opening" arrangement for attaching a sealing membrane, i.e. the membrane 21*a* will be ruptured along a weakening denotation arranged in advance, when the female and male elements 11*a* and 13*a*** are separated.

Figure 3:
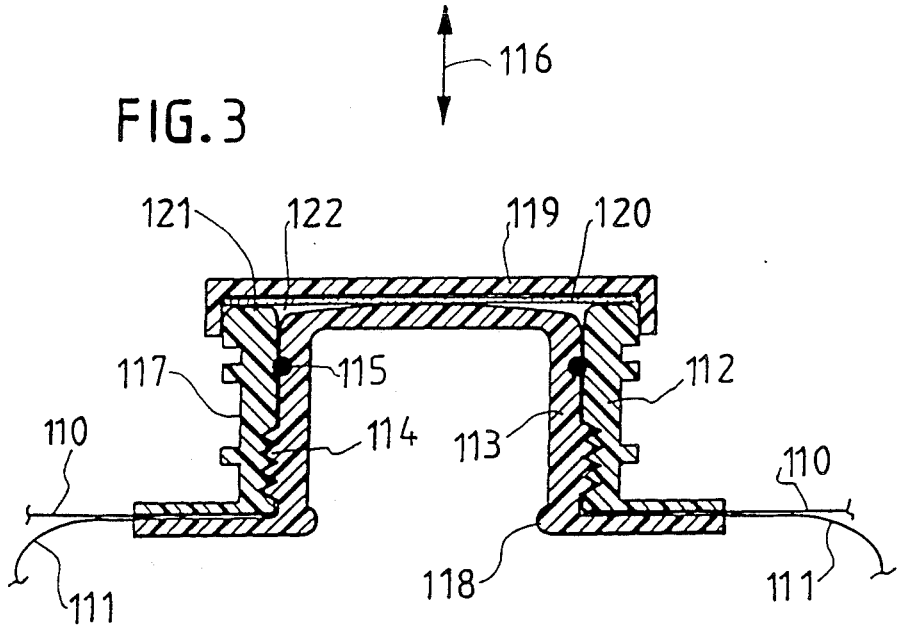
FIG. 3 shows the male and female elements of a spout in a sealing engagement and comprising a barrier layer forming a buffert space between the inside of the layer and said female and male element.

The reference number 110 i FIG. 3 denotes a first container wall portion, and the male 111 denotes a second portion of a container wall. In this specific case said elements are formed of a flexible laminate having high quality gas and vapour barrier characteristics. As an example of such barrier material a metalized polyester may be mentioned. The wall parts 110, 111 are parts which together form a "pouch", for instance containing 100 liter or more, and in the figures it is to be understood that the pouch is a pouch sealed along four sides and for instance compressed at the middle portion, whereby for instance the wall 110 is the upper wall of the pouch, and the wall 111 forms the lower wall of the pouch.

A female element 112 is attached, gas and vapour tight onto the wall or wall portion 110 and in said female element a male element 113 is sealingly, gas and vapour tight, inserted. The male element is attached to the container wall 111 in a manner similar to the element 112.

In FIG. 3 there is shown a circumferential teeth arrangement 114 for increasing the friction between the elements 112, 113 which together form a so-called spout and where the tight seal between the elements is obtained by a circumferential seal in the shape of an O-ring 115. This ring is maintained in a groove in the element 113.

The elements 112, 113 are operative in the direction of the double arrow 116, preferably the female element is maintained stationary by a support gripping a circumferential groove 117 at the external side of the female element 112. Into the male element 113, a rod having expansion members, is brought to grip behind a bead 18 at the inner wall of the male element.

The pouch and the spout attached thereto are delivered in a planar state as shown in FIG. 3 and it should be noted, that the internal region of the pouch is highly sterilized in advance by using gamma radiation or corresponding means. In connection with spouts, it is previously known to use such high degree of sterilization up to the arrangement comprising the seal 115, whereafter the sterile conditions end. In order to provisionally protect the top of the male element and the free outer edge of the female element, normally there is a simple plastics lid 119 or similar attached to the female element 112. When—still using known technique—filling the pouch, i.e. the presterilized pouch, it is enough to remove the cover 119 before filling and attaching the female element to a filler orifice having means for steam sterilization. The steam will hit the side of the male element facing the filler orifice and the "free edge" of the female element and the gap therebetween. Now, it has proved that a much more efficient geometry may be obtained for this type of steam sterilization if, as the case is in FIG. 3, a gas and vapour barrier 120 is arranged, for instance a metallized heat shrinkable plastics film or a high barrier plastics laminate, such that the barrier laminate 120 forms a substantially planar surface seen in a direction towards the filler orifice and such that the barrier layer is steam and gas tight sealed against the edge portion 121 of the female element 112. The circumferential seal at the edge portion 121 may be a seal obtained by heat sealing the film or membrane 20, or a coating means, onto the edge portion surface which may be heat sealable or provided with a heat sealable coating. The space 122 formed between the barrier layer 120 and the male element 113 can be regarded as a buffert space which together with the internal region of the not filled container 110, 111 may be exposed to a high degree of sterilization by using radiation without coming into conflict with the problems mentioned at the introduction.

In the embodiment according to FIG. 3 the barrier layer 120 is a heat shrinkable material layer which shrinks and ruptures when steam is supplied, such that it opens up an opening corresponding to the opening of the female element 112, meaning that in practice there do not remain any flow disturbing edge in regions of the material layer 120.

Figure 4:
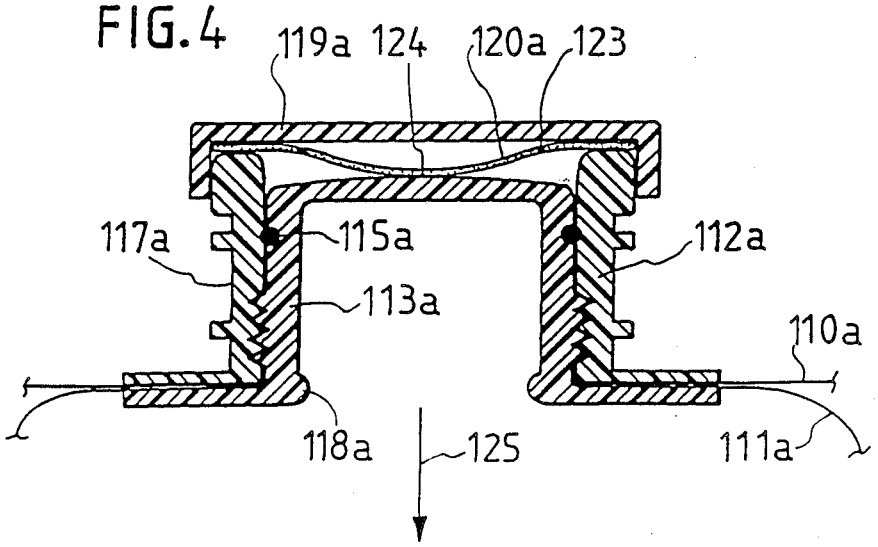
FIG. 4 shows a modified version of a spout comprising a buffert space but here obtained by a sealing membrane provided with a weakening or a tearing denotation.

In FIG. 4, the same reference numbers but with the addition a have been used for corresponding elements, there is arranged a layer having a circumferential tearing denotation 23*a* instead of the layer 120 of a heat shrinkable material. Additionally, this layer is attached or sealed to the top of the female element 113*a*. When the male element 113*a* is pulled in the direction of the arrow 125, the barrier layer 120*a* will be penetrated along the weakening 123 and the opening of the female element will be exposed for filling, of course after having sterilized the region above the barrier layer 20, for instance in the traditional way by using steam.

Although the inventive idea as been described with reference to some specific examples, it is realised that modifications and alternatives are possible within the scope of the accompanying claims.

What we claim is:

1. In a container closure, comprising a female element arranged for being attached to a flexible container wall, and a male element arranged for being attached to an opposite wall, where the elements are arranged for being brought into sealing engagement for closing a container comprising said container walls, the improvement in that an axially operating sealing device is arranged between the male and female elements, and that a locking device of the bayonet coupling type, acting between said male and female elements, presses the male and female elements axially and thereby also the sealing device located between said elements.

2. A closure as in claim 1, wherein the sealing device comprises a sealing ring arranged between a circumferential edge region of the inside of a circumferential region around the bottom of the female element and a circumferential region of the external end surface of the male element.

3. A closure as in claim 1, wherein the axial locking device also is arranged as a sealing device.

4. A closure as in claim 3, wherein the locking device is formed integral with the male element and the female element, respectively, by interval injection moulding.

5. A closure as in claim 1, wherein a sealing membrane is attached, gas and vapour tight, against the outside of the circumferential region of the female element.

6. A closure as in claim 1, wherein the sealing device and/or the material of the male-female element comprises a bacteria killing material, for instance ZEOLIT.

7. In a container closure, comprising a female element attachable to a flexible container wall, a male element attachable to an opposite wall, preferably also of a flexible material, where said elements are arranged for being brought into a sealing engagement and for separation from such engagement and where the male element is arranged for being inserted into the female element from the inside of the container for sealing the container, of which said walls form a part, the improvement that a device forming a barrier layer has means for forming a gas and vapour tight seal against the female element, and that a buffert space is formed between said barrier layer and the male element, said buffert space being highly sterilizable, for instance by means of gamma radiation, together with the rest of the container.

8. A closure as in claim 7, wherein the female element has means for connecting the side of the barrier layer facing away from the buffert space to a filler orifice that is sterilizable by water vapour or similar means.

9. A closure as in claim 8, wherein the barrier layer is formed by a heat shrinkable layer of plastics or plastics laminate, possibly in combination with metal, which is such that it ruptures and exposes the buffert space after said steam sterilization.

10. A closure as in claim 8, wherein the barrier layer comprises a sealing membrane attachable to the outside of the male element, said membrane being of plastics or plastics laminate, possibly containing metal and so attached to the male element that it ruptures substantially along a line defining the opening of the female element when separating the male element from the female element.

11. A closure as in claim 10, wherein the barrier layer is provided with a tearing denotation for obtaining said tearing-through line.

* * * * *